US012799651B2

(12) United States Patent
Fujihara

(10) Patent No.: US 12,799,651 B2
(45) Date of Patent: Nov. 17, 2026

(54) SEWING MACHINE

(71) Applicant: BROTHER KOGYO KABUSHIKI KAISHA, Nagoya (JP)

(72) Inventor: Shinya Fujihara, Obu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 314 days.

(21) Appl. No.: 18/394,540

(22) Filed: Dec. 22, 2023

(65) Prior Publication Data

US 2024/0209555 A1 Jun. 27, 2024

(30) Foreign Application Priority Data

Dec. 27, 2022 (JP) ..... 2022-210732

(51) Int. Cl.
*D05B 27/08* (2006.01)

(52) U.S. Cl.
CPC ..... *D05B 27/08* (2013.01)

(58) Field of Classification Search
CPC ..... D05B 27/00–08
USPC ..... 112/303, 312–313, 324
See application file for complete search history.

(56) References Cited

U.S. PATENT DOCUMENTS 4,691,654 A * 9/1987 Meier ..... D05B 27/02 112/303
4,714,040 A * 12/1987 Kasuga ..... D05B 27/02 112/323
4,958,580 A * 9/1990 Asaba ..... D05B 27/02 112/323

FOREIGN PATENT DOCUMENTS

JP H03-21730 Y2 5/1991

* cited by examiner

*Primary Examiner* — Nathan E Durham
(74) *Attorney, Agent, or Firm* — Oliff PLC

(57) ABSTRACT

A sewing machine includes a lower shaft, a feed dog, a feed bracket, a first shaft, a first arm, a second shaft, a second arm, an engagement receiving portion, an adjustment member, and an urging member. The first arm is configured to support the feed bracket to be swingable around the first shaft. The second shaft is fixed to the first arm and extending in a shaft direction. The engagement receiving portion is configured to engage with the second arm to be movable with respect to the second arm. The adjustment member is configured to swing the first arm around the first shaft and to swing the feed dog supported by the feed bracket in both directions along a transport direction. The urging member is configured to cause an urging force in an action direction along the shaft direction to act on the second arm.

17 Claims, 11 Drawing Sheets

SEWING MACHINE

REFERENCE TO RELATED APPLICATIONS

This application claims priority from Japanese Patent Application No. 2022-210732 filed on Dec. 27, 2022. The entire content of the priority application is incorporated herein by reference.

BACKGROUND ART

The present disclosure relates to a sewing machine.

A sewing machine of related art is provided with a feed cam, an arm, and an urging member, as a configuration for feeding a sewing object using a feed dog. The feed cam swings in accordance with the rotation of a lower shaft. The middle portion of the arm engages with the feed cam, and a position of the arm changes in accordance with the swinging of the feed cam, using the action of an eccentric cam surface of the feed cam. The urging member maintains the engaged state between the arm and the feed cam by urging the arm. A shaft provided on a feed bracket is inserted into one end portion of the arm. By the changes in the position of the arm being transmitted to the feed bracket, the arm operates the feed dog supported by the feed bracket.

SUMMARY

In the sewing machine of the related art, an urging force is imparted to the arm by the urging member. Thus, in the sewing machine, there is a possibility that a defect may occur due to a moment of force generated in the arm, such as seizure of the arm, a feed operation defect, or the like.

Embodiments of the broad principles derived herein provide a sewing machine capable of transmitting, to a feed bracket, a change in the position of an arm included in a configuration for feeding a sewing object using a feed dog, in a more stable manner than in related art.

Embodiments provide a sewing machine that includes a lower shaft, a feed dog, a feed bracket, a first shaft, a first arm, a second shaft, a second arm, an adjustment member, and an urging member. The feed dog is configured to transport a sewing object in a transport direction. The feed bracket is configured to support the feed dog. The first shaft extends in a shaft direction. The shaft direction is orthogonal to both an up-down direction and the transport direction. The first arm through which the first shaft is inserted. The first arm is configured to support the feed bracket to be swingable around the first shaft. The second shaft is fixed to the first arm and extending in the shaft direction. The second arm, through which the second shaft is inserted, is supported to be movable along the shaft direction. The engagement receiving portion is configured to engage with the second arm to be movable with respect to the second arm. The adjustment member is configured to swing the first arm around the first shaft and to swing the feed dog supported by the feed bracket in both directions along the transport direction, by displacing the second arm in accordance with rotation of the lower shaft, in a state of the engagement receiving portion and the second arm being engaged with each other. The urging member is configured to cause an urging force in an action direction along the shaft direction to act on the second arm.

In the sewing machine, when the second adjustment member has displaced the second arm, the feed bracket supported by the first arm swings around the first shaft, and the feed dog swings in both directions along the transport direction. Since the urging force of the action direction is applied to the second arm by the urging member, the state of engagement between the engagement receiving portion and the second arm is stably maintained. On the other hand, when the urging force from the urging member acts on the second arm, the second arm can move in the shaft direction. In the sewing machine, the urging force applied to the second arm is not easily transmitted to the second shaft and the first arm. Thus, compared to the related art, the second arm of the sewing machine contributes both to stably maintaining the state of engagement between the engagement receiving portion and the second arm, and also to reducing a possibility of the occurrence of problems such as seizure of the second shaft caused by the urging force impacting the second shaft and the first arm, a feed operation defect, and the like. In other words, the sewing machine contributes to transmitting the change in the position of the second arm to the feed bracket in a more stable manner than in the related art.

Embodiments further provide a sewing machine that includes a lower shaft, a feed dog, a feed bracket, a first shaft, a first arm, a second shaft, a second arm, an engagement receiving portion, an adjustment member, an urging member, and a support member. The feed dog is configured to transport a sewing object in a transport direction. The feed bracket is configured to support the feed dog. The first shaft extends in a shaft direction. The shaft direction is orthogonal to both an up-down direction and the transport direction. The first arm through which the first shaft is inserted. The first arm is configured to support the feed bracket to be swingable around the first shaft. The second shaft is fixed to the first arm and extending in the shaft direction. The second arm, through which the second shaft is inserted, is supported to be movable along the shaft direction. The second arm includes an engagement pin inserted through the second arm and an action portion fixed to the engagement pin. The engagement receiving portion is configured to engage with the engagement pin to be movable with respect to the engagement pin. The adjustment member is configured to swing the first arm around the first shaft and to swing the feed dog supported by the feed bracket in both directions along the transport direction, by displacing the second arm in accordance with rotation of the lower shaft, in a state of the engagement receiving portion and the engagement pin of the second arm being engaged with each other. The urging member is configured to cause an urging force to act on the second arm in an action direction that is a direction, of the shaft direction, in which a coupling section between the first arm and the second shaft is positioned with respect to the second arm. The support member includes a first wall and a second wall facing each other in the shaft direction. A first pin insertion portion through which the engagement pin is inserted and a first shaft insertion portion through which the second shaft is inserted is formed in the first wall. A second pin insertion portion through which the engagement pin is inserted and a second shaft insertion portion through which the second shaft is inserted is formed in the second wall. The support member has a U shape with the first wall and the second wall. The first wall and the second wall form side surfaces of the support member, and the support member is configured to support the engagement pin inserted through the first pin insertion portion and the second pin insertion portion, with respect to the first arm, via the second shaft inserted through the first shaft insertion portion and the second shaft insertion portion.

In the sewing machine, when the second adjustment member has displaced the second arm, the feed bracket supported by the first arm swings around the first shaft, and the feed dog swings in both directions along the transport direction. Since the urging force of the action direction is applied to the second arm by the urging member, the state of engagement between the engagement receiving portion and the second arm is stably maintained. On the other hand, when the urging force from the urging member acts on the second arm, the second arm can move in the shaft direction. In the sewing machine, the urging force applied to the second arm is not easily transmitted to the second shaft and the first arm. Thus, compared to the related art, the second arm of the sewing machine contributes both to stably maintaining the state of engagement between the engagement receiving portion and the second arm, and also to reducing a possibility of the occurrence of problems such as seizure of the second shaft caused by the urging force impacting the second shaft and the first arm, a feed operation defect, and the like. In other words, the sewing machine contributes to transmitting the change in the position of the second arm to the feed bracket in a more stable manner than in the related art. The sewing machine can relatively simplify the configuration of the engagement receiving portion, can avoid that the urging force from the urging member is transmitted to each of a coupling section of the first arm and the second shaft and a leading end of the second shaft. Compared to a case in which the support member is not provided, by supporting the engagement pin using the support member, the sewing machine can suppress the engagement pin from wobbling when the engagement pin moves with respect to the engagement receiving portion, and the state of the engagement pin being engaged with the engagement receiving portion is stable and easily maintained. In other words, the support member of the sewing machine contributes to transmitting the change in the position of the second arm to the feed bracket in a more stable manner than in the related art.

DESCRIPTION

An embodiment of the present disclosure will be explained with reference to the drawings. A physical configuration of a sewing machine 1 will be explained with reference to FIG. 1. The up-down direction, the upper right side, the lower left side, the lower right side and the upper left side of FIG. 1 respectively correspond to the up-down direction, the right side, the left side, the front side, and the rear side of the sewing machine 1. The longitudinal direction of a bed portion 11 and an arm portion 13 is the left-right direction of the sewing machine 1. The side on which a pillar 12 is disposed is the right side. The extending direction of the pillar 12 is the up-down direction of the sewing machine 1.

Figure 1:
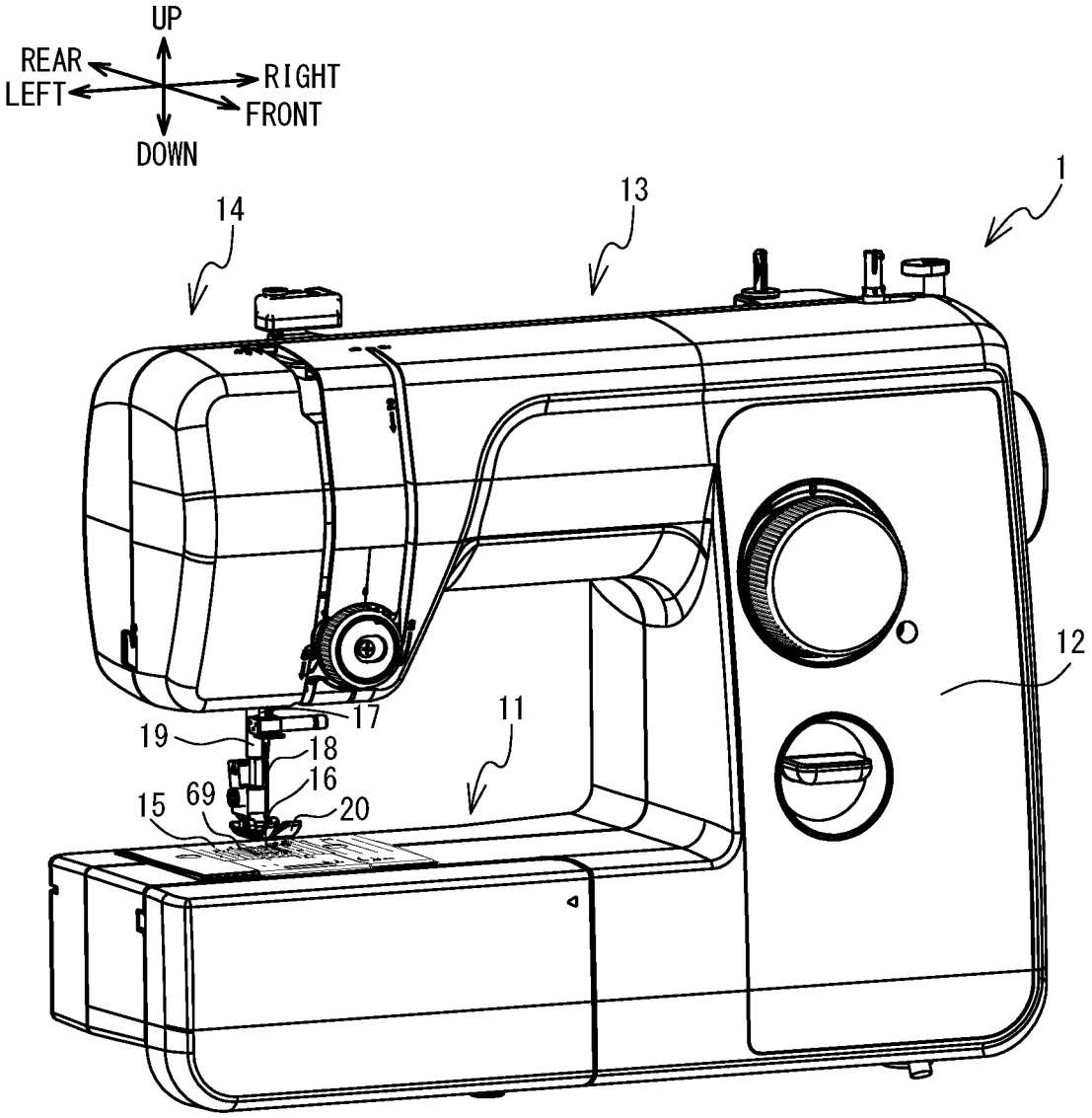
FIG. 1 is a perspective view of a sewing machine.
Figure 2:
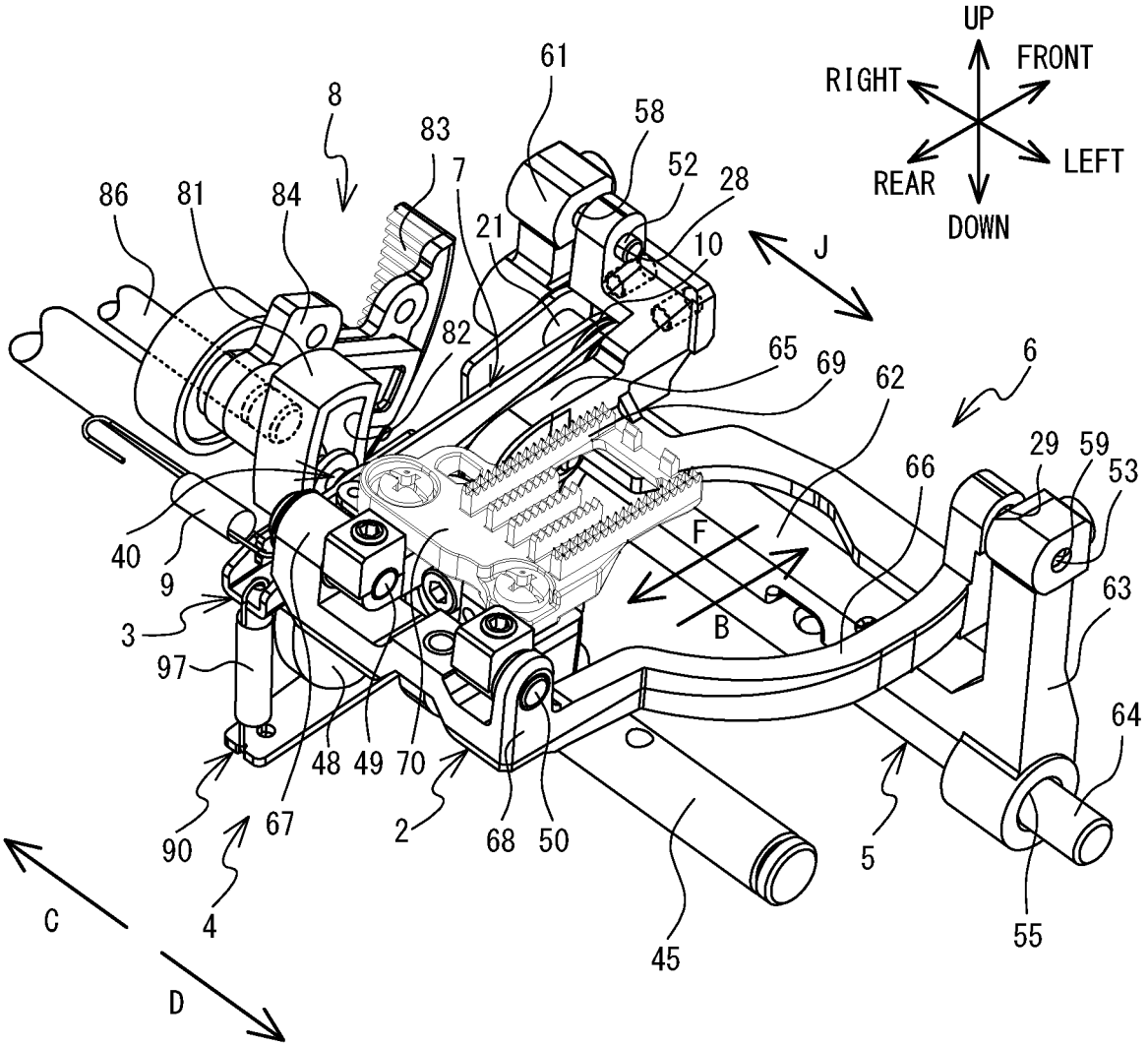
FIG. 2 is a perspective view of a front-rear feed mechanism.

As illustrated in FIG. 1, the sewing machine 1 is provided with the bed portion 11, the pillar 12, the arm portion 13, and a head portion 14. The bed portion 11 is a base portion of the sewing machine 1 that extends in the left-right direction, and is provided with a needle plate 15 on the upper surface the bed portion 11. A plurality of rows of square holes 16, extending in the front-rear direction, are formed in the needle plate 15. As illustrated in FIG. 2, the bed portion 11 is provided with a lower shaft 45, a shuttle mechanism (not shown in the drawings), and a feed mechanism (not shown in the drawings), below the needle plate 15. The lower shaft 45 extends in the left-right direction and is configured to rotate around a shaft center in accordance with driving of a sewing machine motor (not shown in the drawings). The shuttle mechanism includes a horizontal shuttle, is configured to rotate in accordance with the rotation of the lower shaft 45 to cause an upper thread (not shown in the drawings) and a lower thread (not shown in the drawings) to be entwined below the needle plate 15. The feed mechanism includes an up-down feed mechanism (not shown in the drawings) and a front-rear feed mechanism 6, and is configured to cause a feed dog 69 to protrude higher than the square holes 16, in accordance with the rotation of the lower shaft 45. By causing the feed dog 69 to move in a transport direction F in a state of the feed dog 69 being engaged with the sewing object, the feed mechanism transports the sewing object in the transport direction F. The transport direction F of the sewing machine 1 according to the present embodiment is the rearward direction. When performing reverse stitching and the like, the sewing machine 1 can also transport the sewing object in a reverse direction B that is opposite to the transport direction F, namely, in the frontward direction.

As illustrated in FIG. 1, the pillar 12 stands upward from the right end portion of the bed portion 11. The sewing machine motor is provided inside the pillar 12. The arm portion 13 extends to the left from the upper end of the pillar 12, so as to face the bed portion 11. The head portion 14 is a portion coupled to the left leading end portion of the arm portion 13. A needle bar 17, a needle bar mechanism (not shown in the drawings), a presser bar 19, and the like are provided in the head portion 14. A sewing needle 18 can be mounted to the lower end of the needle bar 17. The needle bar mechanism moves the needle bar 17 up and down in accordance with the driving of the sewing machine motor. The presser bar 19 extends in the up-down direction to the rear of the needle bar 17, and moves up and down in synchronization with the driving of the sewing machine motor. A presser foot 20 can be mounted to the lower end of the presser bar 19.

Figure 3:
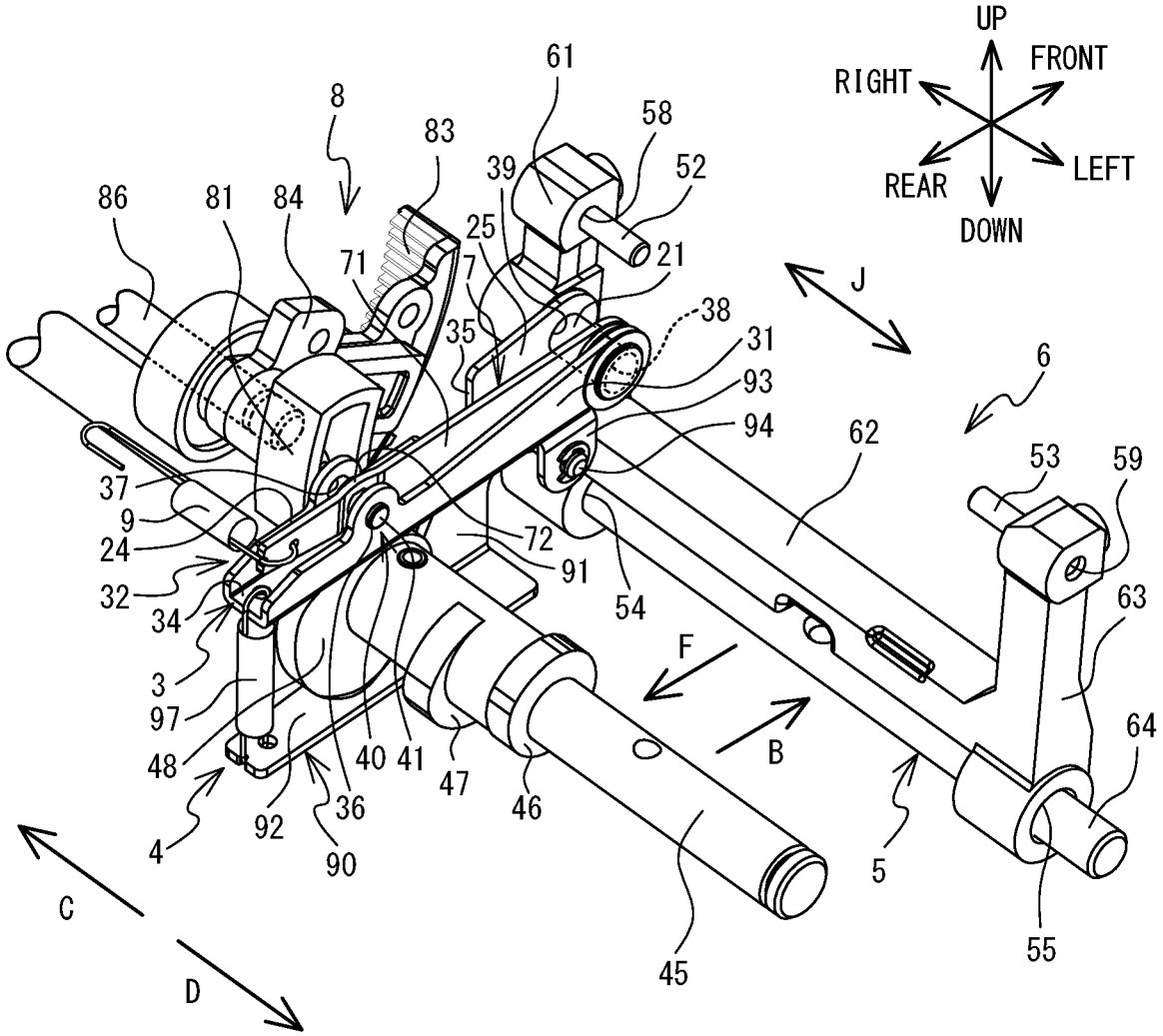
FIG. 3 is a perspective view of a first arm, a second arm, a support member, a first adjustment member, a second adjustment member, an urging member, and a lower shaft.

The front-rear feed mechanism 6 will be described with reference to FIG. 2 to FIG. 7. As illustrated in FIG. 2, the front-rear feed mechanism 6 is provided with the lower shaft 45, the feed dog 69, a feed bracket 2, a first shaft 64, a first arm 5, a second shaft 21, a second arm 7, a first adjustment member 8, a second adjustment member 4, an urging member 9, a regulating portion 10, and a support member 3. As illustrated in FIG. 3, a front-rear feeding cam 48, an up-down feeding cam 47, and an auxiliary cam 46 are provided in that order from the right to the left on the lower shaft 45. The front-rear feeding cam 48 is a cam for swinging the feed bracket 2 in the front-rear direction. The up-down feeding cam 47 and the auxiliary cam 46 are cams for swinging the feed bracket 2 in the up-down direction. Cam surfaces of the front-rear feeding cam 48, the up-down feeding cam 47, and the auxiliary cam 46 are formed on smooth surfaces without any steps. The front-rear feeding cam 48, the up-down feeding cam 47, and the auxiliary cam 46 are integrally formed using a synthetic resin material, and are fixed to the lower shaft 45.

As illustrated in FIG. 2, the feed dog 69 transports the sewing object in the transport direction F. The feed dog 69 is provided with a plate-shaped fixing portion 70. Rear end portions of a plurality of rows of teeth are fixed to the upper surface of the fixing portion 70. The feed bracket 2 supports the feed dog 69. The feed bracket 2 is a U shape that is open toward the front in a plan view, and is provided with a right arm portion 65, a left arm portion 66, a right support portion 67, and a left support portion 68. The right arm portion 65 and the left arm portion 66 are separated from each other in the left-right direction, and extend in the front-rear direction above the lower shaft 45. The right support portion 67 extends upward from the rear end portion of the right arm portion 65. The left support portion 68 extends upward from the rear end portion of the left arm portion 66. The right support portion 67 and the left support portion 68 are separated from each other in the left-right direction. The right support portion 67 pivotally supports the right rear end portion of the fixing portion 70, around a shaft 49 that is fixed protruding to the left from the left surface of the right support portion 67. The left support portion 68 pivotally supports the left rear end portion of the fixing portion 70, around a shaft 50 that is fixed protruding to the right from the right surface of the left support portion 68.

Figure 6:
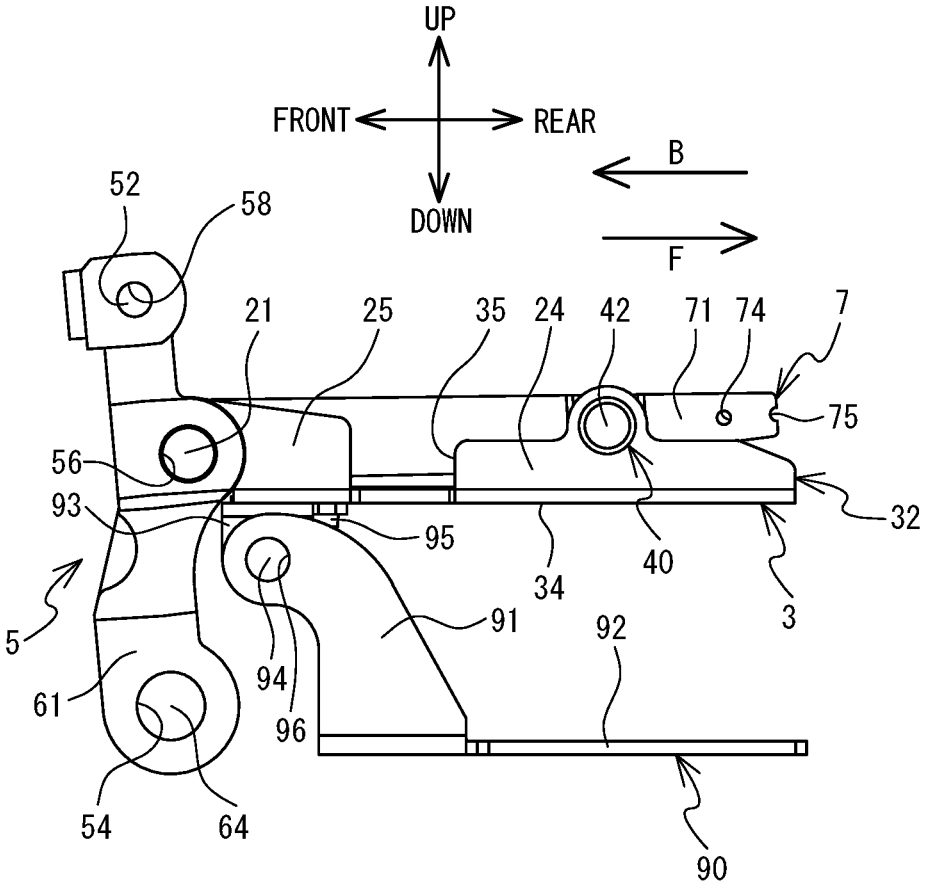
FIG. 6 is a right-side view of the first arm, the second arm, and the support member.

As illustrated in FIG. 3, the first shaft 64 is a cylindrical member that extends in a shaft direction J, which is orthogonal to each of the up-down direction and the transport direction F, to the front of the lower shaft 45. The shaft direction J according to the present embodiment is the left-right direction. The first arm 5 is a U shape that is open upward in a front view. The first shaft 64 is inserted through the first arm 5, and the first arm 5 supports the feed bracket 2 such that the feed bracket 2 can swing around the first shaft 64. The first arm 5 is provided with a right arm portion 61, a left arm portion 63, and a coupling portion 62. The right arm portion 61 and the left arm portion 63 are separated from each other in the left-right direction, and extend in the up-down direction. As illustrated in FIG. 6, a first arm shaft insertion portion 56, a hole 54, and a hole 58 that are circular in a right-side view penetrate the right arm portion 61 in the left-right direction. The hole 54 is formed at the lower end portion of the right arm portion 61, and the hole 58 is formed at the upper end portion of the right arm portion 61. The first arm shaft insertion portion 56 is positioned between the hole 54 and the hole 58 in the up-down direction. The first shaft 64 is inserted through the hole 54. The second shaft 21 is inserted through and fixed to the first arm shaft insertion portion 56. A shaft 52 that extends in the left-right direction is fixed to the hole 58, and the shaft 52 is inserted through an insertion hole 28 provided at the front end of the right arm portion 65 of the feed bracket 2.

As illustrated in FIG. 3, a hole 55 and a hole 59 that are circular in a right-side view penetrate the left arm portion 63 in the left-right direction. The hole 55 is formed at the lower end portion of the left arm portion 63, and the hole 59 is formed at the upper end portion of the left arm portion 63. The first shaft 64 is inserted through the hole 55. A shaft 53 that extends in the left-right direction is fixed to the hole 59, and the shaft 53 is inserted through an insertion hole 29 provided at the front end of the left arm portion 66 of the feed bracket 2. A coupling portion 62 extends in the left-right direction above the first shaft 64, and couples the right arm portion 61 and the left arm portion 63. The first arm 5 pivotally supports the feed bracket 2, around the shafts 52 and 53. The feed bracket 2 is disposed between the right arm portion 61 and the left arm portion 63 in the left-right direction.

Figure 4:
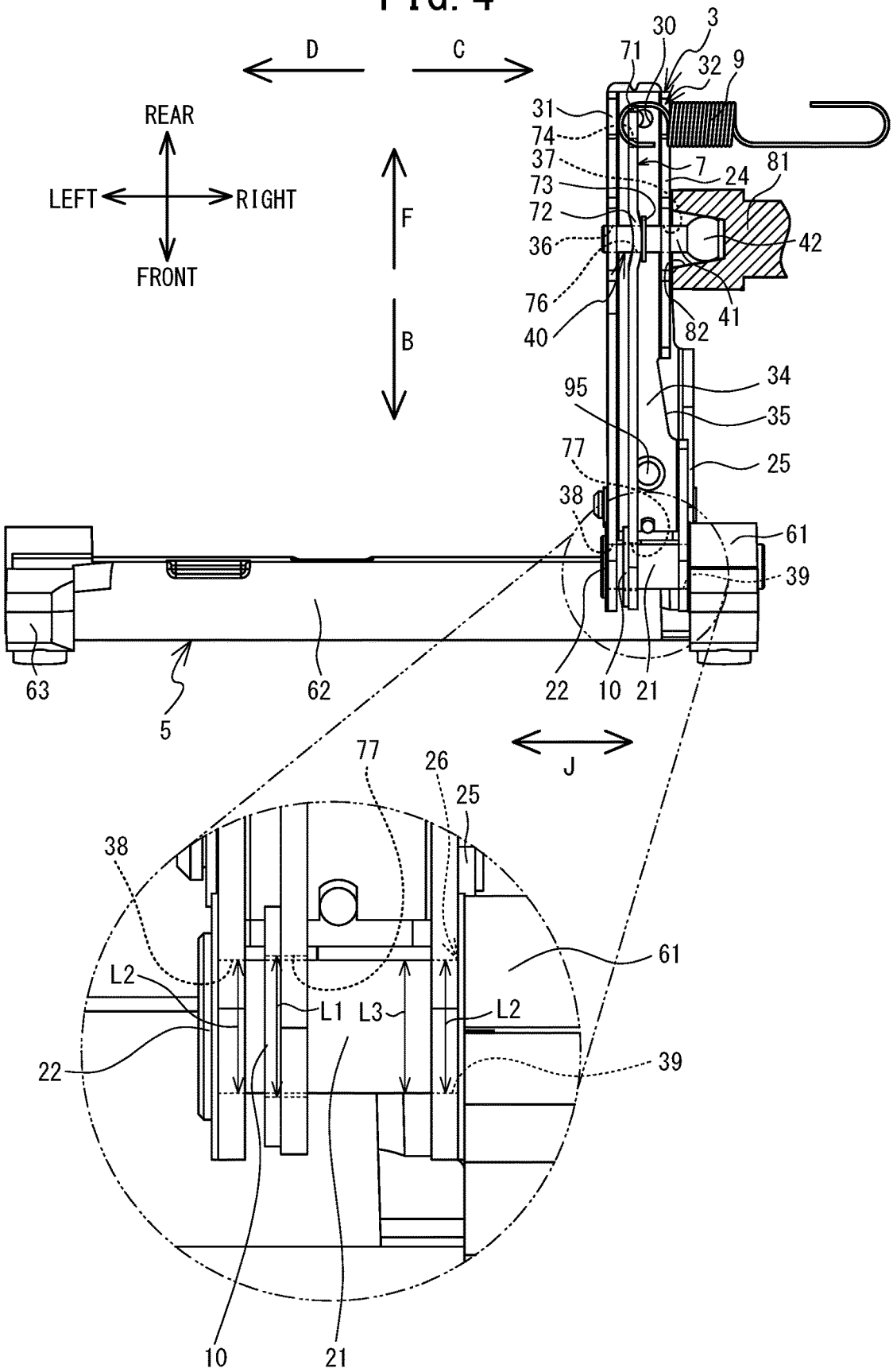
FIG. 4 is a plan view of the first arm, the second arm, the support member, and the urging member.

As illustrated in FIG. 3, FIG. 4, and FIG. 6, the second shaft 21 is inserted through the first arm shaft insertion portion 56 of the right arm portion 61 of the first arm 5, is fixed to the first arm 5, and extends in the shaft direction J. Specifically, the second shaft 21 extends to the left from the left surface of the right arm portion 61 of the first arm 5.

The second shaft 21 is inserted through the second arm 7, and the second arm 7 is supported by the second shaft 21 such that the second arm 7 can move along the shaft direction J. The second arm 7 is provided with a plate 71, an engagement pin 40, and an action portion 73. The plate 71 is a plate that is long in the front-rear direction. The largest surfaces of the plate 71 are the right surface and the left surface that are perpendicular to the left-right direction. As illustrated in FIG. 4 and FIG. 6, a notch 75 is formed in the plate 71, and an urging member coupling portion 74, a pin insertion portion 76, and a second arm shaft insertion portion 77 that are circular in a right-side view penetrate the plate 71 in the left-right direction. The notch 75 is a portion cut out in a semi-circular shape toward the front from the rear end of the plate 71, and guides the left end portion of the urging member 9. The urging member coupling portion 74 is a hole provided in front of the notch 75, and a hook provided at the left end portion of the urging member 9 is inserted through the urging member coupling portion 74. The pin insertion portion 76 is formed slightly further to the rear than a center, in the front-rear direction, of the plate 71, and the second arm shaft insertion portion 77 is formed at the front end portion of the plate 71. The second shaft 21 is inserted through the second arm shaft insertion portion 77 formed at the front end portion, which is one end portion of the second arm 7 in the transport direction F. In a state in which the second shaft 21 is inserted through the second arm shaft insertion portion 77, a slight gap is formed between the second arm shaft insertion portion 77 and the second shaft 21, which allows movement of the second arm 7 in the up-down direction and the front-rear direction.

As illustrated in FIG. 4, the engagement pin 40 is provided with a main body portion 41, and a head portion 42. The main body portion 41 has a cylindrical shape and extends in the left-right direction in parallel to the second shaft 21, and is inserted through the second arm 7. The engagement pin 40 is inserted into the pin insertion portion 76 of the second arm 7, between the second arm shaft insertion portion 77 and the urging member coupling portion 74 of the second arm 7. The head portion 42 has a larger diameter than the diameter of the main body portion 41, and is coupled to the right end of the main body portion 41 further to the right than the plate 71 and the support member 3. The head portion 42 has a spherical shape, and the outer periphery of the head portion 42 is a smooth curved shape. The action portion 73 is fixed to the main body portion 41 of the engagement pin 40, and causes an urging force of the urging member 9 imparted to the second arm 7 to act on the engagement pin 40. The action portion 73 according to the present embodiment is a retaining ring fixed to the main body portion 41, at the right of the plate 71. In order for the plate 71 of the second arm 7 to be in contact with the action portion 73, the plate 71 includes a protruding portion 72 that protrudes in an action direction C. As a result of the protruding portion 72 coming into contact with the action portion 73, the plate 71 of the second arm 7 causes the urging force to act on the engagement pin 40.

Figure 7:
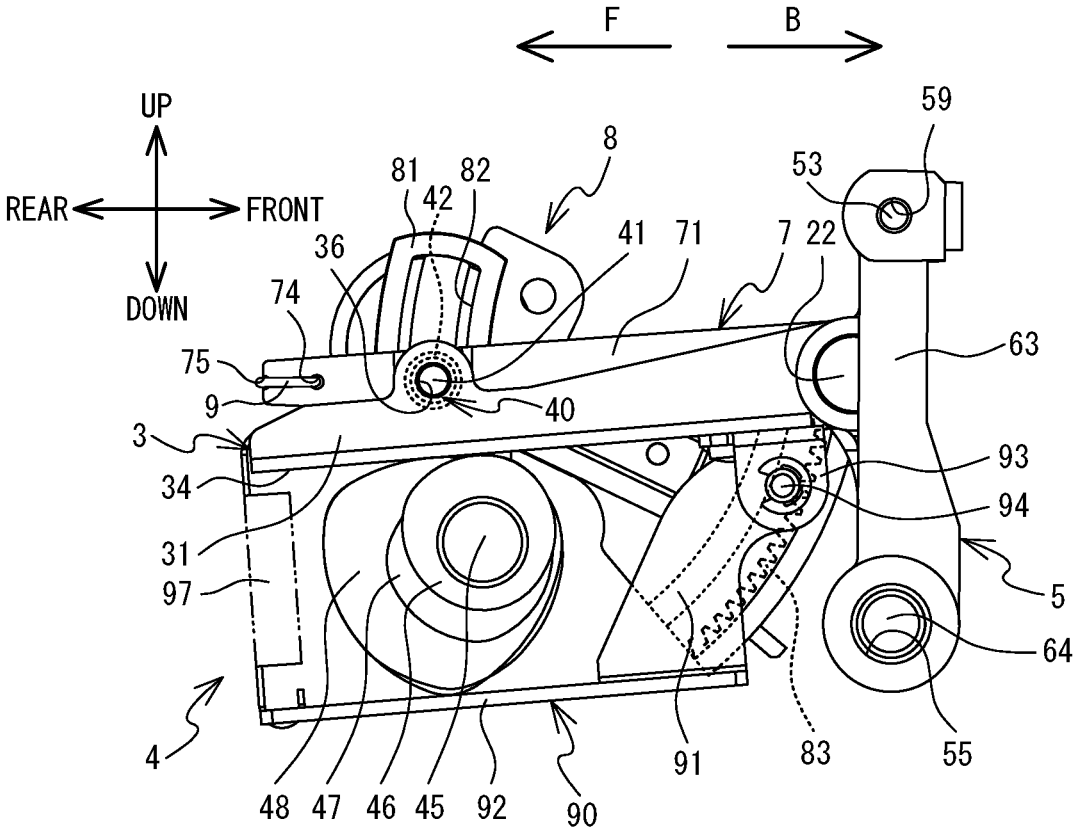
FIG. 7 is a left-side view of the first arm, the second arm, the support member, the first adjustment member, the second adjustment member, the urging member, and the lower shaft.

As illustrated in FIG. 2 and FIG. 3, the first adjustment member 8 is provided above the lower shaft 45 and to the right of the second arm 7, and is coupled to the second arm 7. The first adjustment member 8 is provided with an engagement receiving portion 81, a feed regulator 83, a member 84, and a shaft 86. The engagement receiving portion 81 has a rectangular shape that is long in the up-down direction in a left-side view, and engages with the head portion 42 of the engagement pin 40. As a result of the engagement between the engagement pin 40 and the engagement receiving portion 81, the second arm 7 engages with the engagement receiving portion 81. A groove 82 that is recessed in the action direction C of the urging member 9 is formed in the engagement receiving portion 81. As illustrated in FIG. 7, a cross-sectional shape of the groove 82 is a tapered shape in which the length thereof in the front-rear direction becomes longer the further to the left in a plan view. The length in the left-right direction of the groove 82 is longer than the length in the left-right direction of the head portion 42. The engagement pin 40 engages with the groove 82 such that the engagement pin 40 can move along the groove 82. In a state in which the engagement pin 40 is engaged with the groove 82, the right end of the engagement pin 40 is separated from a bottom surface of the groove 82. Each of the front end portion and the rear end portion of the outer periphery of the engagement pin 40 comes into contact with the groove 82. The engagement receiving portion 81 is supported such that the posture of the engagement receiving portion 81 can rotate around the shaft 86 extending in the left-right direction, so that an angle of the groove 82 changes. The engagement receiving portion 81 is coupled to the feed regulator 83 via the member 84. The feed regulator 83 includes a fan shape gear that meshes with an output shaft of a feed amount adjustment motor (not shown in the drawings). The feed regulator 83 changes the posture of the engagement receiving portion 81 in accordance with whether the sewing object is to be transported in the transport direction F or is to be transported in the reverse direction B opposite to the transport direction F, and in accordance with a feed amount.

Figure 5:
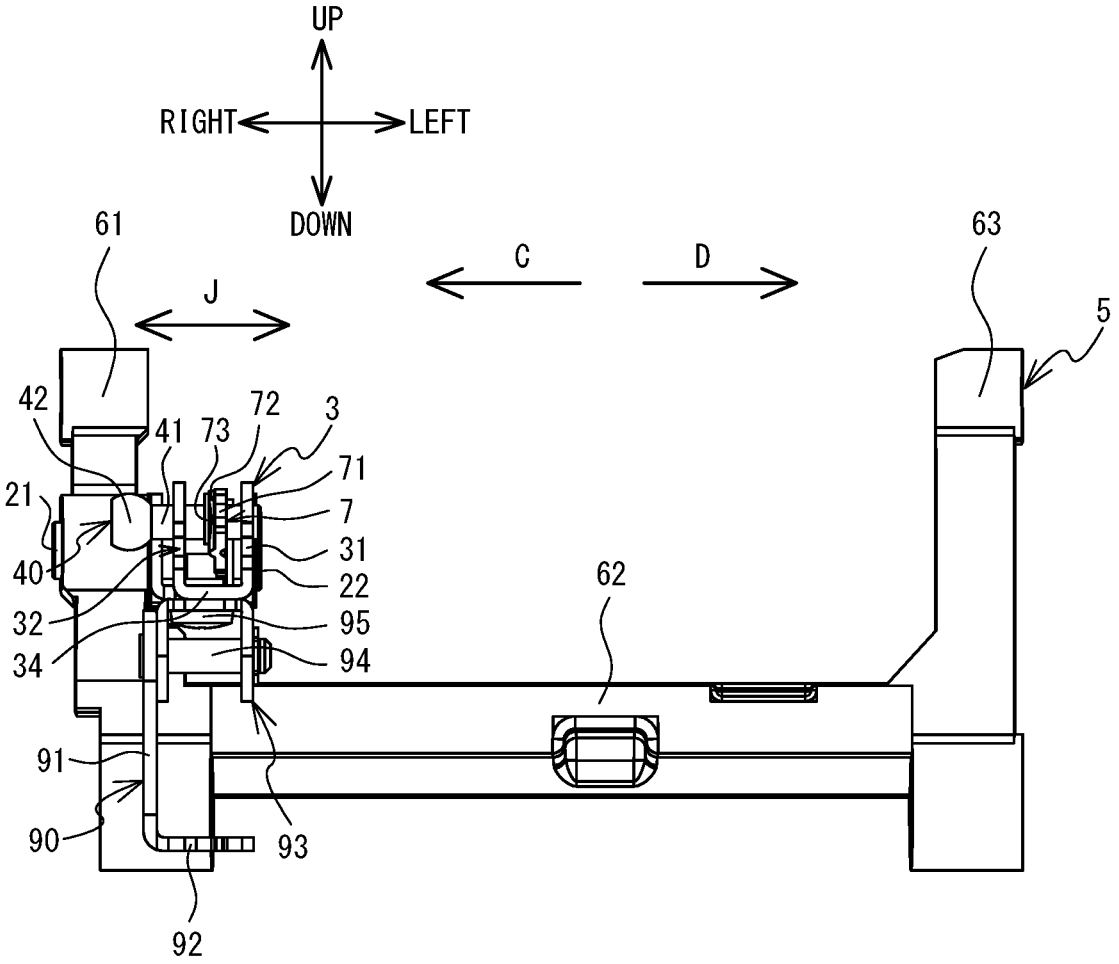
FIG. 5 is a rear view of the first arm, the second arm, the support member, the urging member, and the second adjustment member.

As illustrated in FIG. 3, FIG. 5, and FIG. 7, in accordance with the rotation of the lower shaft 45, the second adjustment member 4 causes the first arm 5 to swing around the first shaft 64, by displacing the second arm 7 in the state in which the engagement receiving portion 81 and the second arm 7 are engaged with each other, and causes the feed dog 69 supported by the feed bracket 2 to swing in both directions along the transport direction F. The second adjustment member 4 includes the front-rear feeding cam 48 fixed to the lower shaft 45 below the second arm 7, and, in the state in which the engagement receiving portion 81 and the second arm 7 are engaged with each other, displaces the second arm 7 in accordance with the rotation of the front-rear feeding cam 48. The second adjustment member 4 is provided with a contact member 90, a second support member 93, a shaft 94, and a second urging member 97. The contact member 90 is a member having a L shape in a right-side view and in a rear view. The contact member 90 is provided with a wall portion 91, and a wall portion 92. The wall portion 91 extends in a plate shape in the up-down direction at the front end portion of the contact member 90. An insertion hole 96 that penetrates in the left-right direction is formed in the upper end portion of the wall portion 91, and the shaft 94 is inserted through the insertion hole 96. The wall portion 92 is coupled to the left lower end portion of the wall portion 91, and extends in a plate shape in the front-rear direction. The upper surface of the wall portion 92 comes into contact with the front-rear feeding cam 48.

The second support member 93 has a reverse U shape that is open downward in a rear view. The shaft 94 that extends in the left-right direction is inserted through the second support member 93. The second support member 93 is fixed to the lower surface of a coupling portion 34 of the support member 3, using a screw 95. The second support member 93 is fixed to the lower surface of the support member 3 so as to be able to swing the contact member 90 around the shaft 94. The second urging member 97 is a coil spring. The lower end portion of the second urging member 97 is coupled through the rear end portion of the wall portion 92, and the upper end portion of the second urging member 97 is coupled to the rear end portion of the support member 3. By urging the support member 3 downward, the second urging member 97 urges the second arm 7, which swings around the second shaft 21 integrally with the support member 3, downward. A space between the wall portion 92 and the support member 3 changes depending on the posture of the front-rear feeding cam 48. In a state in which the first adjustment member 8 is coupled to the second arm 7 and the second urging member 97 of the second adjustment member 4 has urged the second arm 7 downward via the support member 3, the second adjustment member 4 displaces the second arm 7 in accordance with the posture of the front-rear feeding cam 48.

As illustrated in FIG. 3 and FIG. 4, the urging member 9 causes the urging force to act on the second arm 7 in the action direction C along the shaft direction J. One end portion of the urging member 9 is coupled to the rear end portion, which is the other end portion, of the second arm 7. The other end portion of the urging member 9 is fixed to a fixing member (not shown in the drawings) at the right of the second arm 7. The urging member 9 according to the present embodiment is a coil spring. The action direction C of the urging member 9 changes depending on the posture of the second arm 7, but is substantially the rightward direction. In the present specification and the drawings, for convenience, the action direction C is illustrated as being the rightward direction, and a reaction direction D that is opposite to the action direction C is illustrated as being the leftward direction. The engagement receiving portion 81 is disposed in the action direction C with respect to the second arm 7.

The support member 3 has a substantially rectangular shape that is long in the front-rear direction in a plan view. Pin insertion portions 36 and 37, through which the engagement pin 40 is inserted, are formed in the support member 3, and support the engagement pin 40 that is inserted through the pin insertion portions 36 and 37. The support member 3 includes s first wall 31 and a second wall 32 that face each other in the shaft direction J, and the coupling portion 34. The support member 3 has a substantially U shape in a rear view, with the first wall 31 and the second wall 32 as side surfaces of the support member 3, and the coupling portion 34 as a bottom surface the support member 3.

The first wall 31 extends from the front end to the rear end of the support member 3. The pin insertion portion 36 and a shaft insertion portion 38, which penetrate the first wall 31 in the left-right direction, are formed in the first wall 31. The second wall 32 is divided into wall portions 24 and 25, by a notch 35, in the front-rear direction and the left-right direction. The wall portion 24 extends from the rear end of the support member 3 to the vicinity of the center of the support member 3 in the front-rear direction. The pin insertion portion 37, which penetrates the wall portion 24 in the left-right direction, is formed in the wall portion 24. The main body portion 41 of the engagement pin 40 is inserted into the pin insertion portions 36 and 37. The wall portion 25 extends from the front end of the support member 3 to the vicinity of the center of the support member 3 in the front-rear direction, in the front-rear direction in front of the wall portion 24. In the left-right direction, the wall portion 25 is positioned further to the right than the wall portion 24. A shaft insertion portion 39, which penetrates the wall portion 25 in the left-right direction, is formed in the wall portion 25. A diameter L2 of the shaft insertion portions 38 and 39 is larger than a diameter L3 of the second shaft 21, and smaller than a diameter L1 of the second arm shaft insertion portion 77 of the second arm 7. The support member 3 is supported by the first arm 5, via the second shaft 21 inserted through the shaft insertion portions 38 and 39. The wall portion 25 comes into contact with the left surface of the right arm portion 61 of the first arm 5. The second arm 7 is disposed between the first wall 31 and the second wall 32 of the support member 3. More specifically, the rear end portion of the second arm 7 is disposed between the first wall 31 and the wall portion 24, and the front end portion of the second arm 7 is disposed between the first wall 31 and the wall portion 25. The coupling portion 34 is disposed below the second arm 7. As illustrated in FIG. 3 and FIG. 7, the lower surface of the coupling portion 34 comes into contact with the cam surface of the front-rear feeding cam 48. A hole 30, which is circular in a plan view and penetrates in the up-down direction, is formed in the rear end portion of the coupling portion 34. The upper end portion of the second urging member 97 is hooked into and coupled with the hole 30.

As illustrated in FIG. 4, the regulating portion 10 is fixed to the second shaft 21, and regulates a movement range of the second arm 7 in the shaft direction J to be within a range at which the second arm 7 does not come into contact with at least one selected from the group of the first arm 5 and the leading end of the second shaft 21. The regulating portion 10 is fixed to the second shaft 21, and regulates a movement range of the second arm 7 in the shaft direction J to be within a range at which the second arm 7 does not come into contact with at least one selected from the group of the first wall 31 and the second wall 32. With respect to the second arm 7, the regulating portion 10 is fixed to the second shaft 21 in the reaction direction D that is opposite to the action direction C. The rear end portion of the plate 71 according to the present embodiment is urged to the right by the urging member 9. The engagement pin 40 and the second shaft 21 are respectively inserted through the plate 71. Thus, the front end portion of the plate 71 that is positioned further to the front than the pin insertion portion 76 of the plate 71 moves in a direction separating from a coupling section 26 of the first arm 5 and the second shaft 21, due to a reaction force to the urging force of the urging member 9, namely, moves to the left. The regulating portion 10 according to the present embodiment is a retaining ring, and is fixed to the second shaft 21 in the reaction direction D with respect to the second arm 7, namely, to the left with respect to the second arm 7, and to the right of a leading end portion 22 of the second shaft 21, the leading end portion 22 is the leading end of the second shaft 21. In the left-right direction, the regulating portion 10 is disposed between the first wall 31 and the second wall 32 of the support member 3, and more specifically, between the first wall 31 and the wall portion 25.

Operations of the front-rear feed mechanism 6 when the sewing machine 1 transports the sewing object in the transport direction F and the reverse direction B will be described with reference to FIG. 8A to FIG. 9B. Hereinafter, only the operation of the front-rear feed mechanism 6 will be described, but when the sewing object is transported in the transport direction F by the feed dog 69, in addition to the operation of the front-rear feed mechanism 6, the feed bracket 2 swings up and down in accordance with the posture of the up-down feeding cam 47. Thus, a movement trajectory of the feed dog 69 is substantially rectangular in a right-side view. In both the case of the transport direction F and the reverse direction B, a rotation direction R of the lower shaft 45 is the clockwise direction in a left-side view.

Figure 8A:
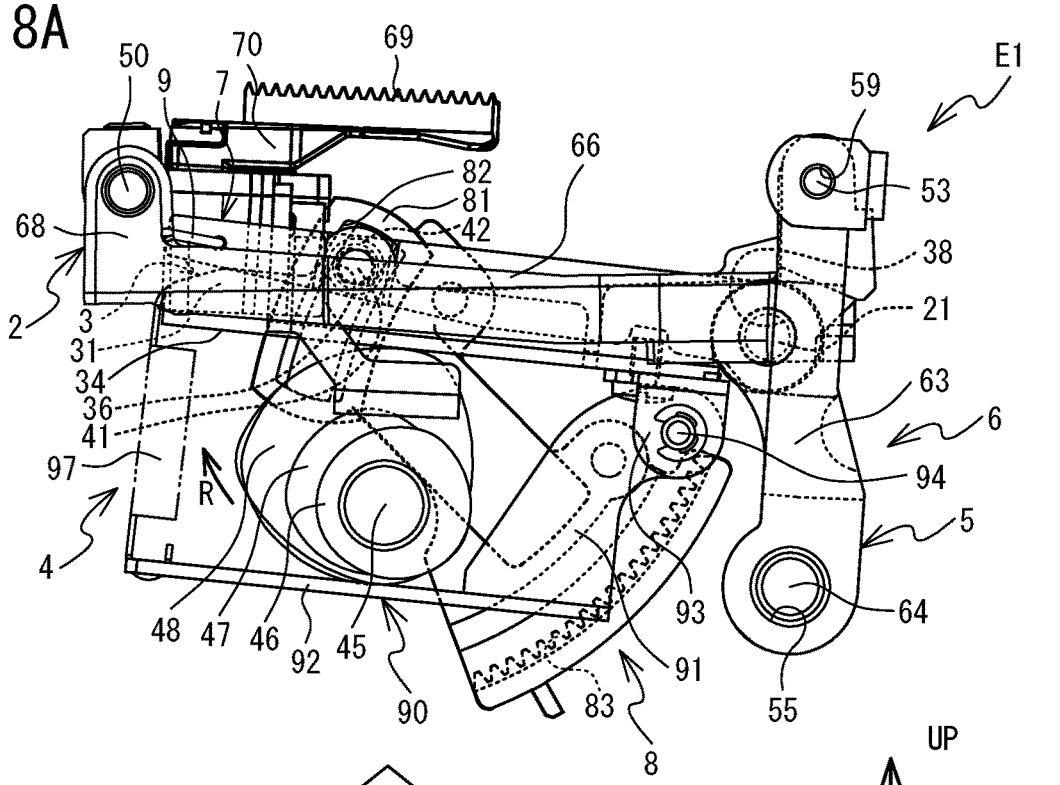
FIG. 8A and FIG. 8B are left side views describing an operation of the front-rear feed mechanism when transporting a sewing object in a transport direction.
Figure 8A:
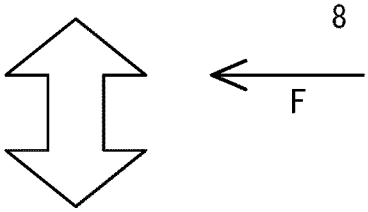
Figure 8A:
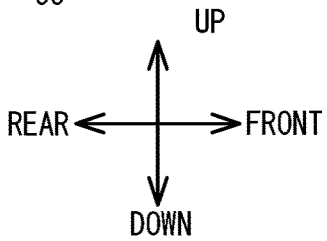
Figure 8B:
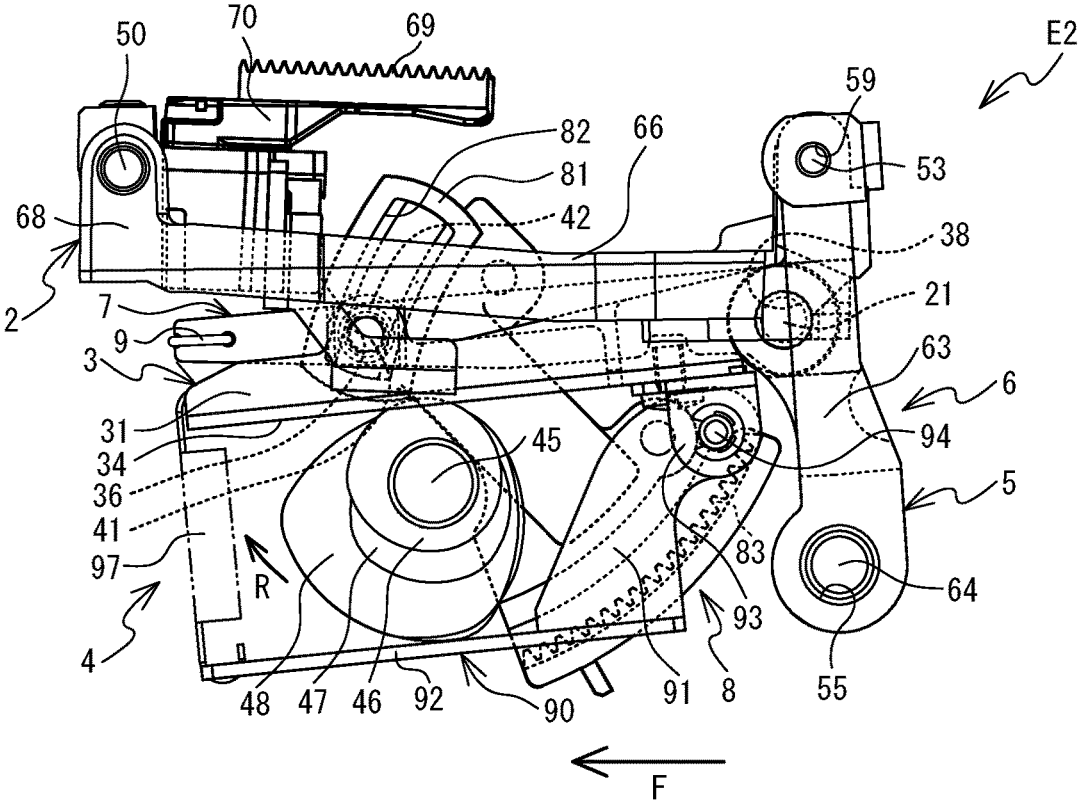

As illustrated in FIG. 8A and FIG. 8B, when the sewing machine 1 transports the sewing object in the transport direction F, the feed regulator 83 is in a posture of being positioned higher the further toward the rear side, and the engagement receiving portion 81 is in a posture of being positioned lower the further toward the rear side. The engagement pin 40 moves with respect to the engagement receiving portion 81 in accordance with the rotation of the lower shaft 45. Specifically, the position of the engagement pin 40 with respect to the engagement receiving portion 81 changes so as to repeatedly alternate between a state E1 and a state E2. When the lower shaft 45 that is the shaft center of the front-rear feeding cam 48 is closest to the support member 3, as illustrated by the state E2, the head portion 42 of the engagement pin 40 is positioned lower than the center, in the up-down direction, of the groove 82 of the engagement receiving portion 81. The feed dog 69 is positioned at a front end portion within a swinging range in the front-rear direction during one stitch. When the lower shaft 45 is closest to the wall portion 92 of the contact member 90, as illustrated by the state E1, the head portion 42 of the engagement pin 40 is positioned higher than the center in the up-down direction of the groove 82 of the engagement receiving portion 81. The feed dog 69 is positioned at a rear end portion within the swinging range in the front-rear direction during one stitch.

Figure 9A:
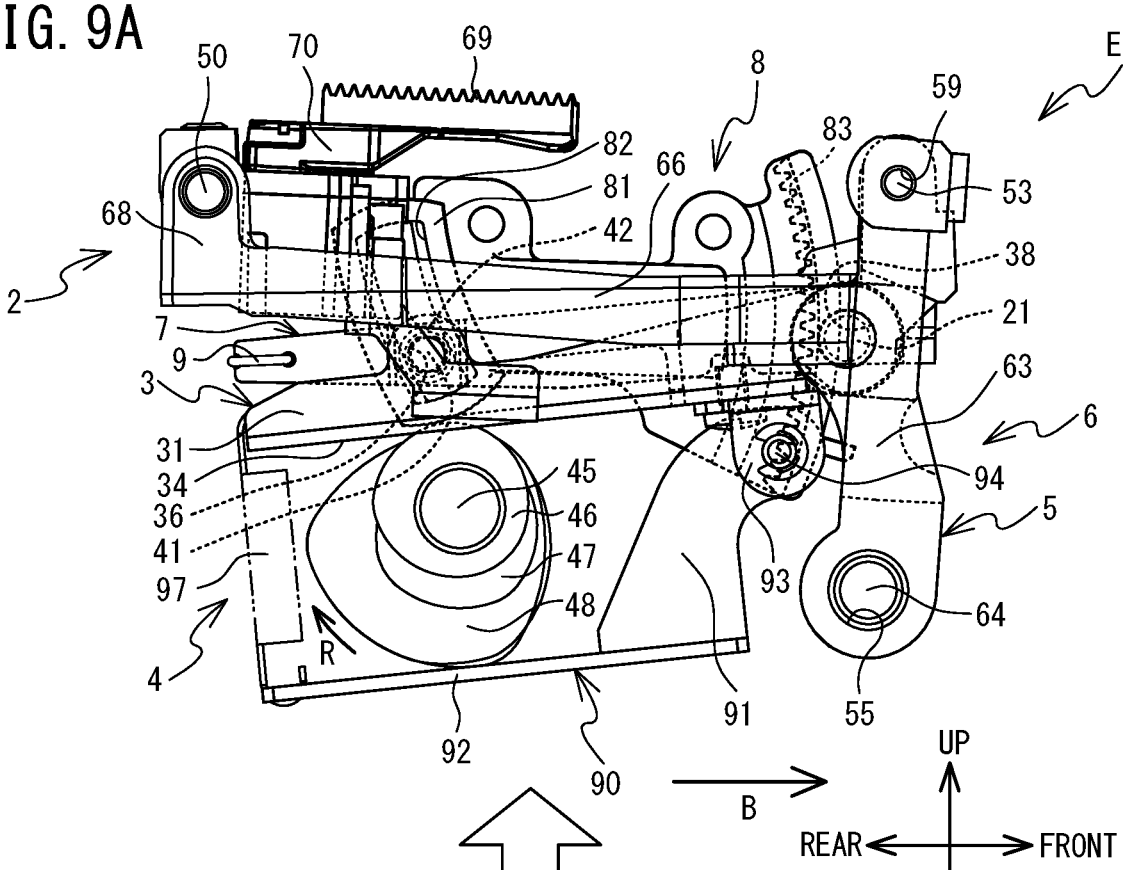
FIG. 9A and FIG. 9B are left side views describing an operation of the front-rear feed mechanism when transporting the sewing object in a reverse direction opposite to the transport direction.
Figure 9B:
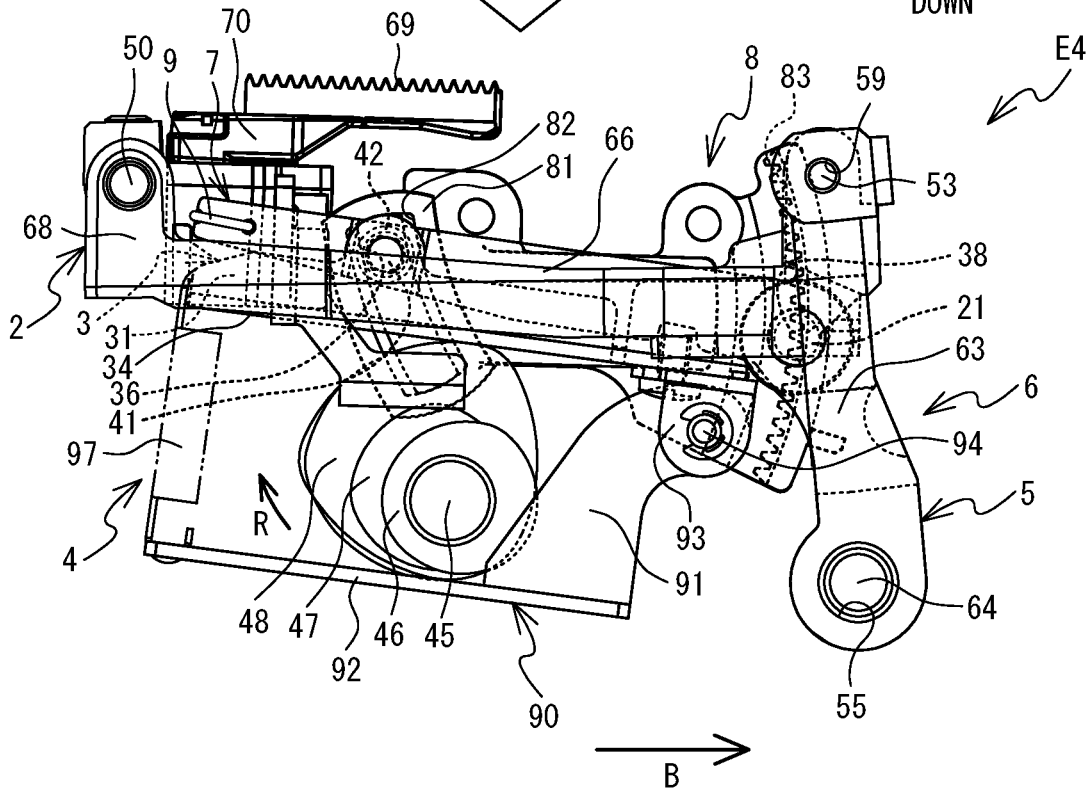

The operation of the front-rear feed mechanism 6 when the sewing machine 1 transports the sewing object in the reverse direction B will be described with reference to FIG. 9A and FIG. 9B. When the sewing machine 1 transports the sewing object in the reverse direction B, the feed regulator 83 is in a posture extending substantially horizontally, and the engagement receiving portion 81 is in a posture of being positioned higher the further toward the rear side. The position of the engagement pin 40 with respect to the engagement receiving portion 81 changes so as to repeatedly alternate between a state E3 and a state E4. When the lower shaft 45 is closest to the wall portion 92 of the contact member 90, as illustrated by the state E4, the head portion 42 of the engagement pin 40 is positioned higher than the center in the up-down direction of the groove 82 of the engagement receiving portion 81. The feed dog 69 is positioned at the front end portion within the swinging range in the front-rear direction during the one stitch. When the lower shaft 45 is closest to the support member 3, as illustrated by the state E3, the head portion 42 of the engagement pin 40 is positioned lower than the center, in the up-down direction, of the groove 82 of the engagement receiving portion 81. The feed dog 69 is positioned at the rear end portion within the swinging range in the front-rear direction during the one stitch.

Figure 10:
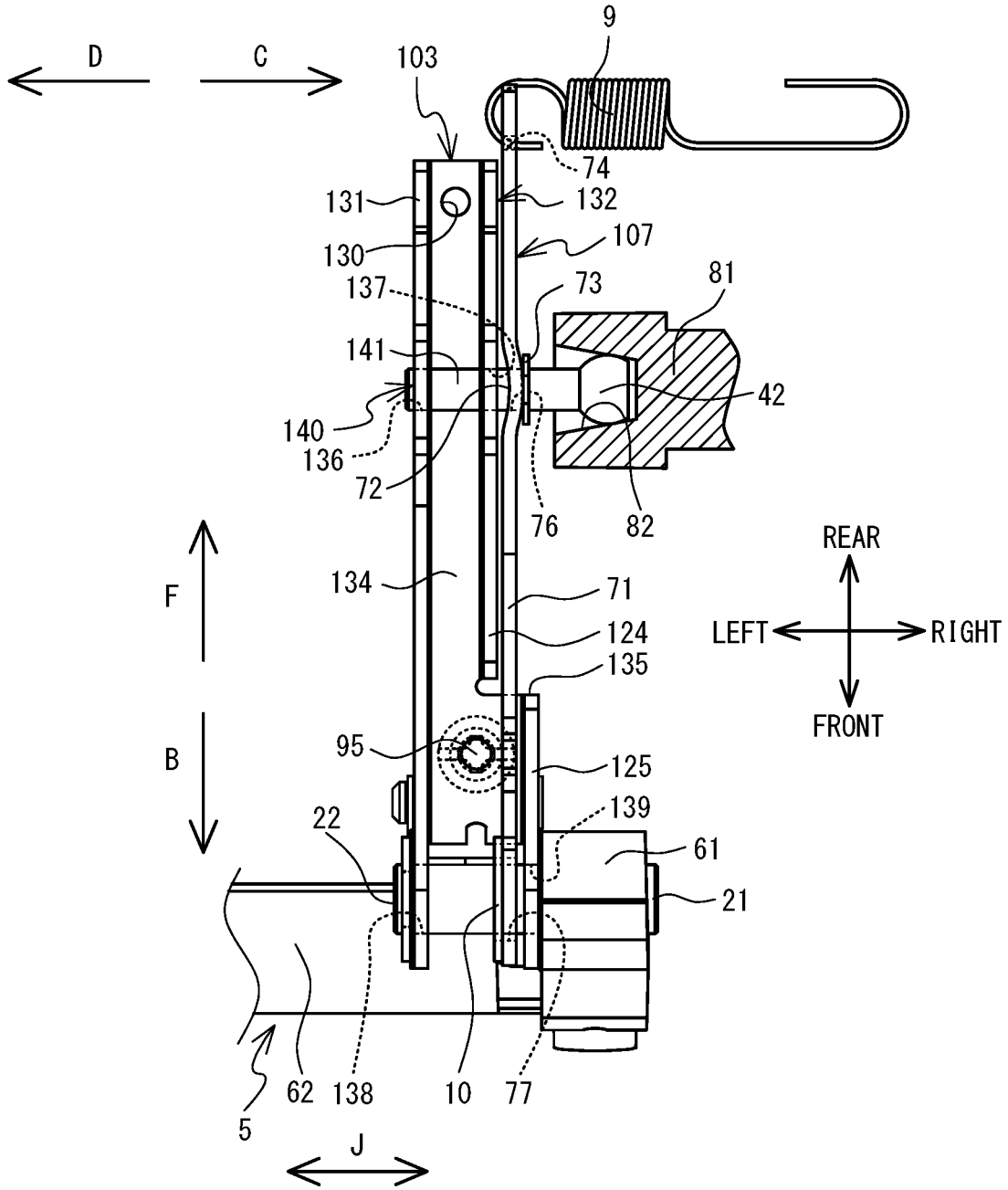
FIG. 10 is a plan view of a second arm and a support member according to a modified example.

In the above-described front-rear feed mechanism 6, the configuration of the support member 3 and the second arm 7, and the arrangement of the second arm 7 with respect to the support member 3 may each be changed as appropriate. A support member 103 and a second arm 107, and an arrangement of the second arm 107 with respect to the support member 103 according to a modified example will be described with reference to FIG. 10. In FIG. 10, the same reference signs are assigned to the configuration that is the same as that of the above-described embodiment, and a description thereof will be omitted or simplified.

As illustrated in FIG. 10, the support member 103 according to the modified example has a rectangular shape that is long in the front-rear direction in a plan view. Pin insertion portions 136 and 137, through which an engagement pin 140 of the second arm 107 is inserted, are formed in the support member 103, and the support member 103 supports the engagement pin 140 inserted through the pin insertion portions 136 and 137. Shaft insertion portions 138 and 139, through which the second shaft 21 is inserted, are formed in the support member 103, and the support member 103 is supported with respect to the first arm 5 by the second shaft 21 inserted through the shaft insertion portions 138 and 139. The support member 103 includes a first wall 131 and a second wall 132 that face each other in the shaft direction J, and a coupling portion 134. The support member 103 has a U shape in a rear view, with the first wall 131 and the second wall 132 as the side surfaces, and the coupling portion 134 as the bottom surface of the support member 3. The second wall 132 is divided into wall portions 124 and 125, by a notch 135, in the front-rear direction and the left-right direction. The wall portion 125 extends from the front end of the support member 103 to the vicinity of the center of the support member 103 in the front-rear direction, in front of the wall portion 124. In the left-right direction, the wall portion 125 is positioned further to the right than the wall portion 124. A hole 130, which is circular in a plan view and penetrates in the up-down direction, is formed in the rear end portion of the coupling portion 134. The upper end portion of the second urging member 97 is hooked into and coupled with the hole 130.

The second arm 107 includes the plate 71, the engagement pin 140, and the action portion 73. The engagement pin 140 includes a main body portion 141 that is longer in the left-right direction than the main body portion 41, and the head portion 42. The head portion 42 is coupled to the right end of the main body portion 141. In the left-right direction, the plate 71 of the second arm 107 is not disposed between the first wall 131 and the wall portion 124, and is disposed to the right of the wall portion 124, between the first wall 131 and the wall portion 125. In the left-right direction, the plate 71 is disposed between the wall portion 124 and the wall portion 125, and is separated in the left-right direction from each of the wall portion 124 and the wall portion 125. In the left-right direction, the action portion 73 and the protruding portion 72 of the second arm 107 are not disposed between the first wall 131 and the wall portion 124, and are disposed to the right of the wall portion 124.

Figure 11:
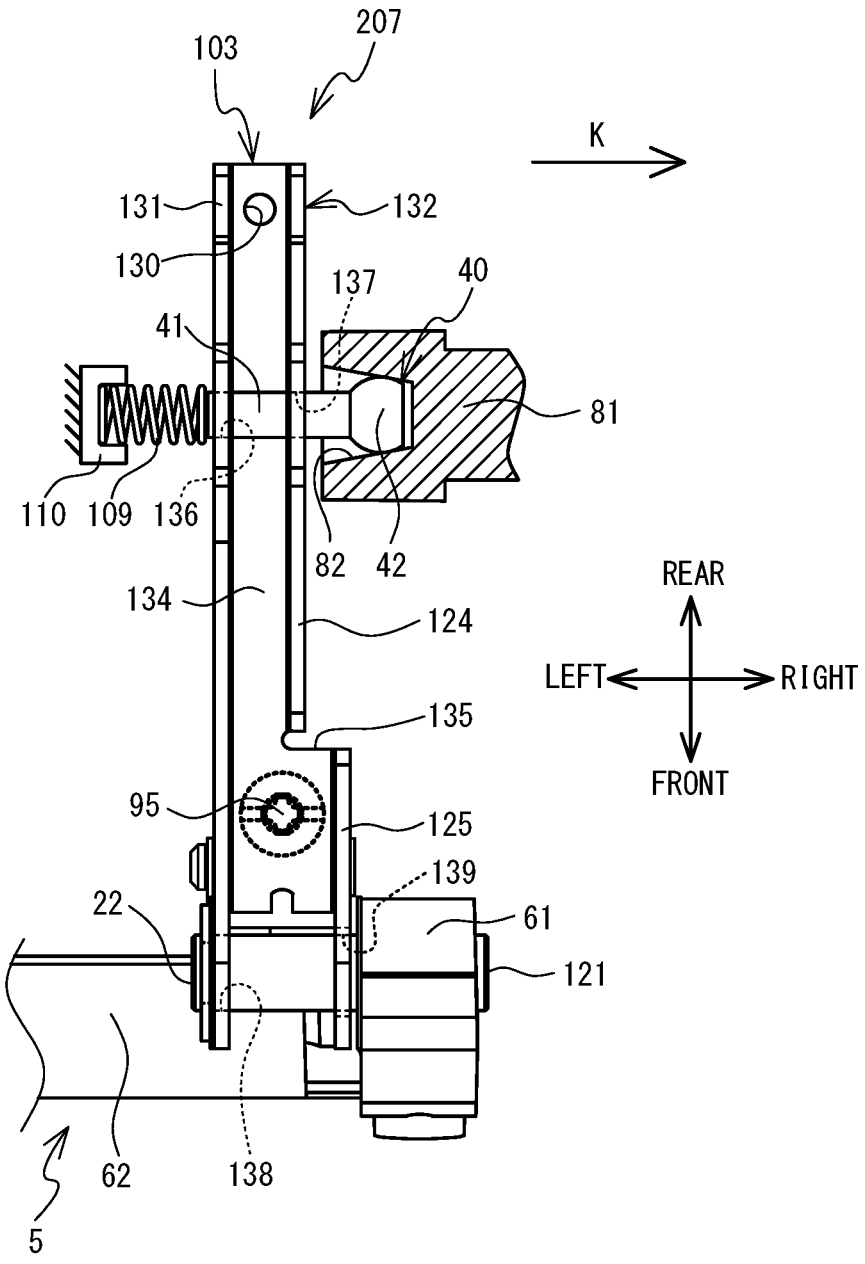
FIG. 11 is a plan view of a second shaft, a second arm, and an urging member according to a modified example.

A second shaft 121, a second arm 207 and an urging member 109 according to a modified example will be described with reference to FIG. 11. In FIG. 11, the same reference signs are assigned to the configuration that is the same as that of the above-described embodiment or the same as that of the modified example illustrated in FIG. 10, and a description thereof will be omitted or simplified. As illustrated in FIG. 11, the length of the second shaft 121 according to the modified example in the shaft direction J is longer than the second shaft 21 according to the above-described embodiment. The second arm 207 includes the support member 103 and the engagement pin 40. The urging member 109 fixed to a fixing member 110 is disposed to the left of the engagement pin 40. The left end of the engagement pin 40 is coupled to the right end of the urging member 109. The engagement pin 40 is urged to the right by the urging member 109. In other words, an action direction K in the modified example is the rightward direction, the engagement pin 40 is directly urged to the right by the urging member 109, and the state of the engagement pin 40 being engaged with the groove 82 of the engagement receiving portion 81 is maintained. The urging force of the urging member 109 is not transmitted to the support member 103, and the support member 103 can move in the shaft direction J with respect to the second shaft 121 and the engagement pin 40. Thus, in the sewing machine 1 according to the modified example illustrated in FIG. 11, there is no need to provide the regulating portion 10, the protruding portion 72, and the action portion 73, as in the above-described embodiment and the modified example illustrated in FIG. 10.

The sewing machine 1 according to the above-described embodiment is provided with the lower shaft 45, the feed dog 69, the feed bracket 2, the first shaft 64, the first arm 5, the second shaft 21, the second arm 7, the engagement receiving portion 81, the second adjustment member 4, and the urging member 9. The feed dog 69 transports the sewing object in the transport direction F. The feed bracket 2 supports the feed dog 69. The first shaft 64 extends in the shaft direction J that is orthogonal to each of the up-down direction and the transport direction F. The first shaft 64 is inserted through the first arm 5, and the first arm 5 supports the feed bracket 2 such that the feed bracket 2 can swing around the first shaft 64. The second shaft 21 is fixed to the first arm 5 and extends in the shaft direction J. The second shaft 21 is inserted through the second arm 7 and the second arm 7 is supported so as to be able to move along the shaft direction J. The engagement receiving portion 81 engages with the second arm 7 so as to be movable with respect to the second arm 7. In accordance with the rotation of the lower shaft 45, the second adjustment member 4 causes the first arm 5 to swing around the first shaft 64, by displacing the second arm 7 in the state in which the engagement receiving portion 81 and the second arm 7 are engaged with each other, and causes the feed dog 69 supported by the feed bracket 2 to swing in both directions along the transport direction F. The urging member 9 causes the urging force of the action direction C along the shaft direction J to act on the second arm 7.

In the sewing machine 1 according to the above-described embodiment, when the second adjustment member 4 has displaced the second arm 7, the feed bracket 2 supported by the first arm 5 swings around the first shaft 64, and the feed dog 69 swings in both directions along the transport direction F. Since the urging force of the action direction C is applied to the second arm 7 by the urging member 9, the state of engagement between the engagement receiving portion 81 and the second arm 7 is stably maintained. On the other hand, when the urging force from the urging member 9 acts on the second arm 7, the second arm 7 can move in the shaft direction J. In the sewing machine 1, the urging force applied to the second arm 7 is not easily transmitted to the second shaft 21 and the first arm 5. Thus, compared to the related art, the second arm 7 of the sewing machine 1 contributes both to stably maintaining the state of engagement between the engagement receiving portion 81 and the second arm 7, and also to reducing a possibility of the occurrence of problems such as seizure of the second shaft 21 caused by the urging force impacting the second shaft 21 and the first arm 5, a feed operation defect, and the like. In other words, the sewing machine 1 contributes to transmitting the change in the position of the second arm 7 to the feed bracket 2 in a more stable manner than in the related art.

The second arm 7 includes the plate 71, the engagement pin 40 inserted through the plate 71, and the action portion 73 that is fixed to the engagement pin 40 and causes the urging force of the urging member 9 imparted to the second arm 7 to act on the engagement pin 40. The engagement receiving portion 81 engages with the engagement pin 40. The sewing machine 1 contributes to simplifying the configuration between the second arm 7 and the engagement receiving portion 81. Compared to a case in which the action portion 73 is not provided, the sewing machine 1 can cause the urging force of the urging member 9 to reliably act on the engagement pin 40.

The groove 82 that is recessed in the action direction C is formed in the engagement receiving portion 81. The engagement pin 40 engages with the groove 82 so as to be able to move along the groove 82. The engagement receiving portion 81 of the sewing machine 1 contributes to simplifying the configuration of the engagement receiving portion 81 and to stably moving the engagement receiving portion 81 relative to the engagement pin 40. Since the length of the groove 82 in the action direction C is longer than the length of the head portion 42 of the engagement pin 40 in the action direction C and the head portion 42 is accommodated in the groove 82 in the action direction C, the head portion 42 does not easily become disengaged from the groove 82.

The second adjustment member 4 includes the front-rear feeding cam 48 fixed to the lower shaft 45, below the second arm 7. The front-rear feeding cam 48 displaces the second arm 7 by rotating in the state in which the engagement receiving portion 81 is engaged with the second arm 7. Compared to a case in which the second adjustment member 4 is fixed at a location other than below the second arm 7, the second adjustment member 4 of the sewing machine 1 contributes to making the configuration of the sewing machine 1 simpler and more compact.

The sewing machine 1 is provided with the support member 3. The pin insertion portions 36 and 37 through which the engagement pin 40 is inserted are provided in the support member 3, and the support member 3 supports the engagement pin 40 inserted through the pin insertion portions 36 and 37. Compared to a case in which the support member 3 is not provided, by supporting the engagement pin 40 using the support member 3, the sewing machine 1 can suppress the engagement pin 40 from wobbling when the engagement pin 40 moves with respect to the engagement receiving portion 81, and the state of the engagement pin 40 being engaged with the engagement receiving portion 81 is stable and easily maintained. In other words, the support member 3 of the sewing machine 1 contributes to transmitting the change in the position of the second arm 7 to the feed bracket 2 in a more stable manner than in the related art.

The urging member 9 is coupled to the second arm 7. Compared to a case in which the urging member 9 causes the urging force to act on the second arm 7 via other members, since the urging member 9 is directly engaged with the second arm 7, the sewing machine 1 can reliably transmit the urging force of the urging member 9 to the second arm 7, and the configuration of the sewing machine 1 can be simplified.

The shaft insertion portions 38 and 39 through which the second shaft 21 is inserted are formed in the support member 3. The support member 3 is supported by the first arm 5 via the second shaft 21 inserted through the shaft insertion portions 38 and 39. Compared to a case in which the support member 3 is not supported by the first arm 5 via the second shaft 21, the support member 3 of the sewing machine 1 can stably support the engagement pin 40. The shaft insertion portions 38 and 39 of the support member 3 contribute to relatively simplifying the configuration of the support member 3 of the sewing machine 1.

The diameter L1 of the second arm shaft insertion portion 77 of the second arm 7 is larger than the diameter L2 of the shaft insertion portions 38 and 39 of the support member 3. In order for the shaft insertion portions 38 and 39 to be accurately supported by the second shaft 21, each of the diameters L2 and L3 are substantially the same. When the second shaft 21 is inserted into the second arm shaft insertion portion 77, a state is obtained in which there is tolerance with respect to the second shaft 21 inserted into the second arm shaft insertion portion 77. Thus, it is possible to reduce the impact of an inclination of the second arm 7 caused by the urging force of the urging member 9 and of the resulting urging force on the second shaft 21.

The support member 3 includes the first wall 31 and the second wall 32 that face each other in the shaft direction J. The first pin insertion portion 36 and the first shaft insertion portion 38 are formed in the first wall 31. The second pin insertion portion 37 and the second shaft insertion portion 39 are formed in the second wall 32. The support member 3 is supported by the first arm 5 via the second shaft 21 inserted through the first shaft insertion portion 38 and the second shaft insertion portion 39. The support member 3 of the sewing machine 1 contributes to stably supporting the engagement pin 40 using each of the first wall 31 and the second wall 32.

In the shaft direction J, the second arm 7 is disposed between the first wall 31 and the second wall 32 of the support member 3. Compared to a case in which the second arm 7 is not disposed between the first wall 31 and the second wall 32 in the shaft direction J, the sewing machine 1 contributes to reducing an arrangement space of the support member 3 and the second arm 7.

Even when the urging force from the urging member 9 acts on the second arm 7 and the second arm 7 moves in the shaft direction J, the regulating portion 10 of the sewing machine 1 regulates the movement range of the second arm 7 to the range at which the second arm 7 does not come into contact with at least one selected from the group of the first arm 5 and the leading end portion 22 of the second shaft 21. Thus, it is possible to reduce, more than the related art, the possibility of the occurrence of problems such as the seizure of the second arm 7, or a feed operation defect and the like, due to the second arm 7 coming into contact with at least one selected from the group of the first arm 5 and the leading end portion 22 of the second shaft 21.

The sewing machine 1 includes the regulating portion 10 that is fixed to the second shaft 21 between the first wall 31 and the second wall 32 of the support member 3 in the shaft direction J, and that regulates the movement range of the second arm 7 in the shaft direction J to be within the range at which the second arm 7 does not come into contact with at least one selected from the group of the first wall 31 and the second wall 32. Thus, the sewing machine 1 reduces, more than the related art, the possibility of the occurrence of problems such as the seizure of the second arm 7, or the feed operation defect and the like, due to the second arm 7 coming into contact with at least one selected from the group of the first arm 5 and the leading end portion 22 of the second shaft 21, via one selected from the group of the first wall 31 and the second wall 32.

The support member 3 has the U shape with the first wall 31 and the second wall 32 forming the side surfaces of the support member 3. The sewing machine 1 can relatively simplify the configuration of the support member 3, and, compared to a case in which the support member 3 is configured by the single wall portion, contributes to stably supporting the engagement pin 40 using the first wall 31 and the second wall 32.

The second arm 7 includes the protruding portion 72 that protrudes in the action direction C, in order to come into contact with the action portion 73. The second arm 7 causes the urging force to act on the engagement pin 40 as a result of the protruding portion 72 coming into contact with the action portion 73. Compared to a case in which the protruding portion 72 is not provided on the second arm 7, the sewing machine 1 can more reliably transmit to the engagement pin 40, the urging force applied to the second arm 7. Thus, compared to the case in which the protruding portion 72 is not provided on the second arm 7, the sewing machine 1 contributes to stably maintaining the engagement between the engagement pin 40 and the engagement receiving portion 81.

The second arm 7 includes the second arm shaft insertion portion 77 through which the second shaft 21 is inserted and the urging member coupling portion 74 to which the urging member 9 is coupled. The engagement pin 40 is inserted through the second arm 7 between the second arm shaft insertion portion 77 and the urging member coupling portion 74 in the transport direction F. The engagement receiving portion 81 is disposed in the action direction C with respect to the second arm 7. Compared to a case in which the engagement pin 40 is not inserted between the second arm shaft insertion portion 77 and the urging member coupling portion 74 in the transport direction F, the sewing machine 1 contributes to stably maintaining the engagement between the engagement pin 40 and the engagement receiving portion 81.

The sewing machine 1 is provided with the regulating portion 10 that is fixed to the second shaft 21 in the reaction direction D, which is opposite to the action direction C, with respect to the second arm 7, and that regulates the movement range of the second arm 7 in the shaft direction J to be within the range at which the second arm 7 does not come into contact with the leading end portion 22 of the second shaft 21. By regulating the movement range of the second arm 7 in the reaction direction D, the regulating portion 10 of the sewing machine 1 contributes to more reliably inhibiting the second arm 7 from coming into contact with the leading end portion 22 of the second shaft 21.

The sewing machine 1 is provided with the lower shaft 45, the feed dog 69, the feed bracket 2, the first shaft 64, the first arm 5, the second shaft 21, the second arm 7, the engagement receiving portion 81, the second adjustment member 4, the urging member 9, and the support member 3. The second arm 7, through which the second shaft 21 is inserted, is supported to be movable along the shaft direction J. The second arm 7 includes the engagement pin 40 inserted through the second arm 7 and the action portion 73 fixed to the engagement pin 40. The engagement receiving portion 81 is configured to engage with the engagement pin 40 to be movable with respect to the engagement pin 40. The second adjustment member 4 is configured to swing the first arm 5 around the first shaft 64 and to swing the feed dog 69 supported by the feed bracket 2 in both directions along the transport direction F, by displacing the second arm 7 in accordance with rotation of the lower shaft 45, in a state of the engagement receiving portion 81 and the engagement pin 40 of the second arm 7 being engaged with each other. The urging member 9 is configured to cause an urging force to act on the second arm 7 in the action direction that is a direction, of the shaft direction J, in which the coupling section 26 between the first arm 5 and the second shaft 21 is positioned with respect to the second arm 7. The support member 3 includes the first wall 31 and the second wall 32 facing each other in the shaft direction J. The first pin insertion portion 36, through which the engagement pin 40 is inserted and the first shaft insertion portion 38 through which the second shaft 21 is inserted, is formed in the first wall 31. The second pin insertion portion 37, through which the engagement pin 40 is inserted and the second shaft insertion portion 39 through which the second shaft 21 is inserted, is formed in the second wall 32. The support member 3 has the U shape with the first wall 31 and the second wall 32 forming side surfaces of the support member 3, and is configured to support the engagement pin 40 inserted through the pair of pin insertion portions 37 and 38, with respect to the first arm 5, via the second shaft 21 inserted through the first shaft insertion portion 38 and the second shaft insertion portion 39.

The engagement receiving portion 81 of the sewing machine 1 contributes to relatively simplifying the configuration of the engagement receiving portion 81, and to avoiding that the urging force from the urging member 9 is transmitted to each of the coupling section 26 of the first arm 5 and the second shaft 21 and the leading end portion 22 of the second shaft 21. Compared to a case in which the support member is not provided, by supporting the engagement pin 40 using the support member 3, the sewing machine 1 can suppress the engagement pin 40 from wobbling when the engagement pin 40 moves with respect to the engagement receiving portion 81, and the state of the engagement pin 40 being engaged with the engagement receiving portion 81 is stable and easily maintained. In other words, the support member 3 of the sewing machine 1 contributes to transmitting the change in the position of the second arm 7 to the feed bracket 2 in a more stable manner than in the related art.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below:

The configuration of the sewing machine 1 may be changed as appropriate. The sewing machine 1 may be an industrial sewing machine. The configurations of the feed dog 69, the feed bracket 2, and the first arm 5 may be changed as appropriate. The sewing machine 1 may be able to transport the sewing object in one direction only, and need not necessarily be able to adjust the feed amount. In this case, the sewing machine 1 may change the configuration of the first adjustment member 8, and may be provided with only the engagement receiving portion 81. It is sufficient that the second arm 7 and the engagement receiving portion 81 be configured to engage with each other so as to be able to move relative to each other. When the second arm 7 is provided with the engagement pin 40, the engagement receiving portion 81 may be a rail that engages with the engagement pin 40. The engagement receiving portion may be the engagement pin 40, and in this case, in place of the engagement pin 40, the second arm 7 may be a member including the groove 82 that engages with the engagement pin 40. The shape of the front-rear feeding cam 48 may be changed as appropriate. At least one selected from the group of the protruding portion 72 and the action portion 73 may be omitted from the second arm 7, and the configuration, the arrangement, and the like of at least one selected from the group of the protruding portion 72 and the action portion 73 may be changed as appropriate.

The action direction C, the configuration, and a coupling target of the urging member 9 may be changed as appropriate. The urging member 9 may press the engagement receiving portion 81 against the engagement pin 40 by urging the engagement receiving portion 81 in a direction from the engagement receiving portion 81 toward the second arm 7, of the shaft direction J, that is, by urging the engagement receiving portion 81 in the leftward direction. In other words, the engagement receiving portion 81 may be disposed in the reaction direction D, which is opposite to the action direction C of the urging member 9, with respect to the second arm 7. In this case, it is sufficient that the regulating portion 10 be provided between the second arm 7 and the right arm portion 61 of the first arm 5 in the shaft direction J, and the regulating portion 10 may be disposed between the second arm 7 and the wall portion 24, for example. It is sufficient that the action direction C is a direction including a component in the direction along the shaft direction J, and the action direction C may be a direction extending diagonally upward to the right, may be a direction extending diagonally rearward to the right, or the like.

The support member 3 may be omitted as necessary. In this case, the second arm 7 may be configured in an L shape, a reverse T shape, or the like in a back view, and the second adjustment member 4 may be fixed to the lower surface of the second arm 7. The configuration of the support member 3 may be changed as appropriate. The support member 3 need not necessarily be provided with the first wall 31 and the second wall 32, and the shape of the support member 3 may be a desired shape, such as an H shape, an L shape, or the like in a back view. The second wall 32 need not necessarily be divided by the notch 35 in the transport direction F. In other words, the wall portions 24 and 25 may be continuous with each other. The support member 3 may include the first wall 31 and the second wall 32 only at a section supporting the engagement pin 40, and may include the first wall 31 and the second wall 32 only at a section through which the second shaft 21 is inserted. Of the first wall 31 and the second wall 32, only one selected from the group of the first pin insertion portion 36 and the first shaft insertion portion 38 may be formed in the first wall 31 on the side separated from the right arm portion 61 of the first arm 5. The configuration and a coupling target of the second adjustment member 4 may be changed as appropriate in accordance with the configuration of the support member 3. Each of the urging member 9 and the second urging member 97 may be a plate spring, a resin such as rubber, or the like, instead of the coil spring. The second urging member 97 may be coupled with the second arm 7, or may be provided above the second arm 7 and urge the second arm 7 downward directly or via another member, such as the support member 3, or the like.

The configuration of the regulating portion 10 may be changed as appropriate, and the regulating portion 10 may regulate the movement of the second arm 7 in the shaft direction J by a protruding portion being formed protruding from at least a part of the outer periphery of the second shaft 21. The second shaft 21 may be inserted through an end portion of the second arm 7 in the transport direction F, that is, may be inserted through the rear end portion of the second arm 7, or may be inserted through a central portion of the second arm 7 in the transport direction F. In the transport direction F, the portion of the engagement pin 40 coupled to the second arm 7 may be changed as appropriate. In the transport direction F, when the urging member 9 is coupled to the second arm 7 on the second shaft 21 side with respect to the engagement pin 40, the regulating portion 10 may be provided in the action direction C with respect to the second arm 7. The regulating portion 10 may be fixed to the second shaft 21 in each of the action direction C and the reaction direction D with respect to the second arm 7. The regulating portion 10 may be omitted. The movement range of the second arm 7 in the shaft direction J may be changed as appropriate.

What is claimed is:

1. A sewing machine comprising:

a lower shaft;

a feed dog configured to transport a sewing object in a transport direction;

a feed bracket configured to support the feed dog;

a first shaft extending in a shaft direction, the shaft direction being orthogonal to both an up-down direction and the transport direction;

a first arm through which the first shaft is inserted, the first arm being configured to support the feed bracket to be swingable around the first shaft;

a second shaft fixed to the first arm and extending in the shaft direction;

a second arm through which the second shaft is inserted, the second arm being supported to be movable along the shaft direction;

an engagement receiving portion configured to engage with the second arm to be movable with respect to the second arm;

an adjustment member configured to swing the first arm around the first shaft and to swing the feed dog supported by the feed bracket in both directions along the transport direction, by displacing the second arm in accordance with rotation of the lower shaft, in a state of the engagement receiving portion and the second arm being engaged with each other; and an urging member configured to cause an urging force in an action direction along the shaft direction to act on the second arm, wherein the second arm is a member separate from the feed bracket and is configured, when displaced by the adjustment member, to transmit the displacement to the first arm via the second shaft to swing the first arm.

2. The sewing machine according to claim 1, wherein the second arm includes a plate, an engagement pin inserted through the plate, and an action portion fixed to the engagement pin and configured to cause the urging force of the urging member applied to the second arm to act on the engagement pin, and the engagement receiving portion engages with the engagement pin of the second arm.

3. The sewing machine according to claim 2, wherein a groove recessed in the action direction is formed in the engagement receiving portion, and the engagement pin engages with the groove to be movable along the groove.

4. The sewing machine according to claim 2, further comprising:

a support member configured to support the engagement pin inserted through a pin insertion portion, the pin insertion portion, through which the engagement pin is inserted, being formed in the support member.

5. The sewing machine according to claim 4, wherein a shaft insertion portion, through which the second shaft is inserted, is formed in the support member, and the support member is supported by the first arm via the second shaft inserted through the shaft insertion portion.

6. The sewing machine according to claim 5, wherein the second arm includes a second arm shaft insertion portion through which the second shaft is inserted, and a diameter of the second arm shaft insertion portion is larger than a diameter of the shaft insertion portion of the support member.

7. The sewing machine according to claim 5, wherein the support member includes a first wall and a second wall facing each other in the shaft direction, the pin insertion portion and the shaft insertion portion are formed in each of the first wall and the second wall, and the support member is supported by the first arm via the second shaft inserted through a pair of the shaft insertion portion.

8. The sewing machine according to claim 7, wherein the second arm is disposed between the first wall and the second wall of the support member in the shaft direction.

9. The sewing machine according to claim 8, further comprising:

a regulating portion fixed to the second shaft between the first wall and the second wall of the support member in the shaft direction, the regulating portion being configured to regulate a movement range, in the shaft direction, of the second arm to be in a range at which the second arm does not come into contact with at least one selected from a group of the first wall and the second wall.

10. The sewing machine according to claim 7, wherein the support member is formed in a U shape with the first wall and the second wall forming side surfaces of the support member.

11. The sewing machine according to claim 2, wherein the second arm includes a protruding portion protruding in the action direction, for coming into contact with the action portion, and the second arm causes the urging force to act on the engagement pin by the protruding portion coming into contact with the action portion.

12. The sewing machine according to claim 2, wherein the second arm includes a second arm shaft insertion portion through which the second shaft is inserted and an urging member coupling portion to which the urging member is coupled, the engagement pin is inserted through the second arm between the second arm shaft insertion portion and the urging member coupling portion in the transport direction, and the engagement receiving portion is disposed in the action direction with respect to the second arm.

13. The sewing machine according to claim 12, further comprising:

a regulating portion fixed to the second shaft in a reaction direction with respect to the second arm, the reaction direction being opposite to the action direction, and the regulating portion being configured to regulate a movement range, in the shaft direction, of the second arm to be in a range at which the second arm does not come into contact with a leading end of the second shaft.

14. The sewing machine according to claim 1, wherein the adjustment member includes a feeding cam fixed to the lower shaft below the second arm, and the adjustment member displaces the second arm in accordance with rotation of the feeding cam in a state of the engagement receiving portion and the second arm being engaged with each other.

15. The sewing machine according to claim 1, wherein the urging member is coupled to the second arm.

16. The sewing machine according to claim 1, further comprising:

a regulating portion fixed to the second shaft, the regulating portion being configured to regulate a movement range, in the shaft direction, of the second arm to be in a range at which the second arm does not come into contact with at least one selected from a group of the first arm and a leading end of the second shaft.

17. A sewing machine comprising:

a lower shaft;

a feed dog configured to transport a sewing object in a transport direction;

a feed bracket configured to support the feed dog;

a first shaft extending in a shaft direction, the shaft direction being orthogonal to both an up-down direction and the transport direction;

a first arm through which the first shaft is inserted, the first arm being configured to support the feed bracket to be swingable around the first shaft;

a second shaft fixed to the first arm and extending in the shaft direction;

a second arm through which the second shaft is inserted, the second arm being supported to be movable along the shaft direction, and the second arm including an engagement pin inserted through the second arm and an action portion fixed to the engagement pin;

an engagement receiving portion configured to engage with the engagement pin to be movable with respect to the engagement pin;

an adjustment member configured to swing the first arm around the first shaft and to swing the feed dog supported by the feed bracket in both directions along the transport direction, by displacing the second arm in accordance with rotation of the lower shaft, in a state of the engagement receiving portion and the engagement pin of the second arm being engaged with each other;

an urging member configured to cause an urging force to act on the second arm in an action direction that is a direction, of the shaft direction, in which a coupling section between the first arm and the second shaft is positioned with respect to the second arm; and a support member including a first wall and a second wall facing each other in the shaft direction, a first pin insertion portion through which the engagement pin is inserted and a first shaft insertion portion through which the second shaft is inserted being formed in the first wall, a second pin insertion portion through which the engagement pin is inserted and a second shaft insertion portion through which the second shaft is inserted being formed in the second wall, the support member having a U shape with the first wall and the second wall, the first wall and the second wall forming side surfaces of the support member, and the support member being configured to support the engagement pin inserted through the first pin insertion portion and the second pin insertion portion, with respect to the first arm, via the second shaft inserted through the first shaft insertion portion and the second shaft insertion portion.

* * * * *